US010267573B2

(12) United States Patent
Bennett et al.

(10) Patent No.: US 10,267,573 B2
(45) Date of Patent: Apr. 23, 2019

(54) POLYHEDRAL ARRAY HEAT TRANSFER TUBE

(75) Inventors: Donald L. Bennett, Franklin, KY (US); Liangyou Tang, Shanghai (CN); James E. Bryan, Columbia, MO (US)

(73) Assignee: LUVATA ALLTOP (ZHONGSHAN) LTD., Zhongshan (CN)

( * ) Notice: Subject to any disclaimer, the term of this patent is extended or adjusted under 35 U.S.C. 154(b) by 615 days.

(21) Appl. No.: 12/231,439

(22) Filed: Sep. 2, 2008

(65) Prior Publication Data

US 2009/0008075 A1 Jan. 8, 2009

Related U.S. Application Data

(63) Continuation of application No. 11/599,219, filed on Nov. 13, 2006, now abandoned, which is a continuation of application No. 10/304,668, filed on Nov. 25, 2002, now abandoned.

(51) Int. Cl.
*F28F 1/40* (2006.01)
*F28F 1/42* (2006.01)

(52) U.S. Cl.
CPC ..... *F28F 1/40* (2013.01); *F28F 1/422* (2013.01)

(58) Field of Classification Search
CPC ..... F28F 1/40; F28F 1/422
USPC ..... 165/133, 179, 184
See application file for complete search history.

(56) References Cited

U.S. PATENT DOCUMENTS

| | | | |
|---|---|---|---|
| 3,088,494 | A | 5/1963 | Koch et al. |
| 3,750,709 | A | 8/1973 | French |
| 3,786,653 | A | 1/1974 | Blomberg |
| 3,861,462 | A | 1/1975 | McLain |
| 3,885,622 | A | 5/1975 | McLain |
| 3,902,552 | A | 9/1975 | McLain |

(Continued)

FOREIGN PATENT DOCUMENTS

| | | |
|---|---|---|
| JP | 58-18092 | 2/1983 |
| JP | 61-6595 | 9/1987 |

(Continued)

*Primary Examiner* — Leonard R Leo
(74) *Attorney, Agent, or Firm* — JCIPRNET

(57) ABSTRACT

A heat exchanger tube that comprises a tubular member having a longitudinal axis and having an inner surface that is divided into at least two regions along the circumferential direction. A first plurality of polyhedrons are formed on the inner surface along at least one polyhedral axis. Each of the polyhedrons have four opposite sides. The polyhedrons have first and second faces that are disposed parallel to the polyhedral axis and have third and fourth faces disposed oblique to the polyhedral axis. The polyhedral axis is disposed at a first helical angle with respect to the longitudinal axis of the tube. A second plurality of polyhedrons is formed on the inner surface adjacent to the first plurality of polyhedrons. The second plurality of polyhedrons is disposed along at least one polyhedral axis. Each of the polyhedrons has four opposite sides. The polyhedrons have first and second faces disposed parallel to the polyhedral axis and have third and fourth faces disposed oblique to the polyhedral axis. The polyhedral axis is disposed at a second helical angle with respect to the longitudinal axis of the tube. The orientation of the second helical angle is opposite to the orientation of the first helical angle.

20 Claims, 8 Drawing Sheets

(56) References Cited

U.S. PATENT DOCUMENTS

| | | | |
|---|---|---|---|
| 3,906,605 | A | 9/1975 | McLain |
| 4,470,452 | A | 9/1984 | Rhodes |
| 4,480,684 | A | 11/1984 | Onishi et al. |
| 4,658,892 | A | 4/1987 | Shinohara et al. |
| 4,690,211 | A | 9/1987 | Kuwahara et al. |
| 4,705,103 | A | 11/1987 | Zogg et al. |
| 5,010,643 | A | 4/1991 | Zohler |
| 5,259,448 | A | 11/1993 | Masukawa et al. |
| 5,586,598 | A | 12/1996 | Tanaka et al. |
| 5,682,946 | A | 11/1997 | Schmidt et al. |
| 5,791,405 | A | 8/1998 | Takiura et al. |
| 5,975,196 | A | 11/1999 | Gaffaney et al. |
| 5,992,512 | A | 11/1999 | Tsuri et al. |
| 6,164,370 | A | 12/2000 | Robinson et al. |
| 6,182,743 | B1 | 2/2001 | Bennett et al. |
| 6,298,909 | B1 | 10/2001 | Fukatami et al. |
| 6,308,775 | B1 | 10/2001 | Naumann |
| 2003/0111215 | A1 | 6/2003 | Walther et al. |

FOREIGN PATENT DOCUMENTS

| | | | | | |
|---|---|---|---|---|---|
| JP | 63-172893 | | | 7/1988 | |
| JP | 02161267 | A | * | 6/1990 | ..... F25B 39/00 |
| JP | 9318288 | A | | 12/1997 | |
| JP | 10-200279 | | | 11/1998 | |
| JP | 10-300379 | A1 | | 11/1998 | |

* cited by examiner

POLYHEDRAL ARRAY HEAT TRANSFER TUBE

CROSS-REFERENCE TO RELATED APPLICATION

The present application is a continuation application claiming priority to U.S. patent application Ser. No. 10/304,668 filed Nov. 25, 2002 entitled "Polyhedral Array Heat Transfer Tube."

FIELD OF INVENTION

The present invention relates to tubes used in heat exchangers and more particularly, the invention relates to a heat exchanger tube having an internal surface that is capable of enhancing the heat transfer performance of the tube.

BACKGROUND OF THE INVENTION

The heat transfer performance of a tube having surface enhancements is known by those skilled in the art to be superior to a plain walled tube. Surface enhancements have been applied to both internal and external tube surfaces, including ribs, fins, coatings, and inserts, and the like. All enhancement designs attempt to increase the heat transfer surface area of the tube. Most designs also attempt to encourage turbulence in the fluid flowing through or over the tube in order to promote fluid mixing and break up the boundary layer at the surface of the tube.

A large percentage of air conditioning and refrigeration, as well as engine cooling, heat exchangers are of the plate fin and tube type. In such heat exchangers, the tubes are externally enhanced by use of plate fins affixed to the exterior of the tubes. The heat exchanger tubes also frequently have internal heat transfer enhancements in the form of modifications to the interior surface of the tube.

In a significant proportion of the total length of the tubing in a typical plate fin and tube air conditioning and refrigeration heat exchanger, the refrigerant exists in both liquid and vapor states. Below certain flow rates and because of the variation in density, the liquid refrigerant flows along the bottom of the tube and the vaporous refrigerant flows along the top. Heat transfer performance of the tube is improved if there is improved intermixing between the fluids in the two states, e.g., by promoting drainage of liquid from the upper region of the tube in a condensing application or encouraging liquid to flow up the tube in a wall by capillary action in evaporating application.

In order to reduce the manufacturing costs of the heat exchangers, it is also desirable to reduce the weight of the heat transfer tube while maintaining performance.

Internal enhancement of the tube increases the heat transfer coefficient of the heat exchanger. Increasing this coefficient increases the amount of heat exchanged if the heat exchanger remains at the original size and volume or creates the possibility of reducing the size of the heat exchanger while maintaining performance.

Accordingly, what is needed is a heat transfer tube that provides superior performance for condensing and/or evaporating applications and that offers practical and economical features to end users.

SUMMARY OF THE INVENTION

The present invention meets the above-described need by providing a heat exchanger tube that comprises a tubular member having a longitudinal axis and having an inner surface that is divided into at least two regions along the circumferential direction. A first plurality of polyhedrons are formed on the inner surface along at least one polyhedral axis. Each of the polyhedrons have four opposite sides. The polyhedrons have first and second faces disposed parallel to the polyhedral axis and have third and fourth faces disposed oblique to the polyhedral axis. The polyhedral axis is disposed at a first helical angle with respect to the longitudinal axis of the tube. A second plurality of polyhedrons is formed on the inner surface adjacent to the first plurality of polyhedrons. The second plurality of polyhedrons is disposed along at least one polyhedral axis. Each of the polyhedrons has four opposite sides. The polyhedrons have first and second faces disposed parallel to the polyhedral axis and have third and fourth faces disposed oblique to the polyhedral axis. The polyhedral axis is disposed at a second helical angle with respect to the longitudinal axis of the tube. The orientation of the second helical angle is opposite to the orientation of the first helical angle. For a typical round tube there may be four equal sized regions. However as will be described below, the regions may have different sizes and there may be multiple regions totaling more than four.

BRIEF DESCRIPTION OF THE DRAWINGS

The invention is illustrated in the drawings in which like reference characters designate the same or similar parts throughout the figures of which.

DETAILED DESCRIPTION

Throughout this specification the term polyhedron is used and it is to be defined as a solid formed by substantially planar faces.

The tube of the present invention is preferably formed out of copper, copper alloy, or other metallic or non-metallic material. The tube may be round, oval, or even flat in cross-section. The tube may be cylindrical with an outside diameter, inside diameter and corresponding wall thickness.

The internal surface of the tube is formed with the internal surface enhancement of the present invention.

The heat exchanger tube of the present invention may be formed by roll embossing the enhancement pattern on one surface on a strip of material before roll forming and seam welding the strip into a tube.

Figure 1:
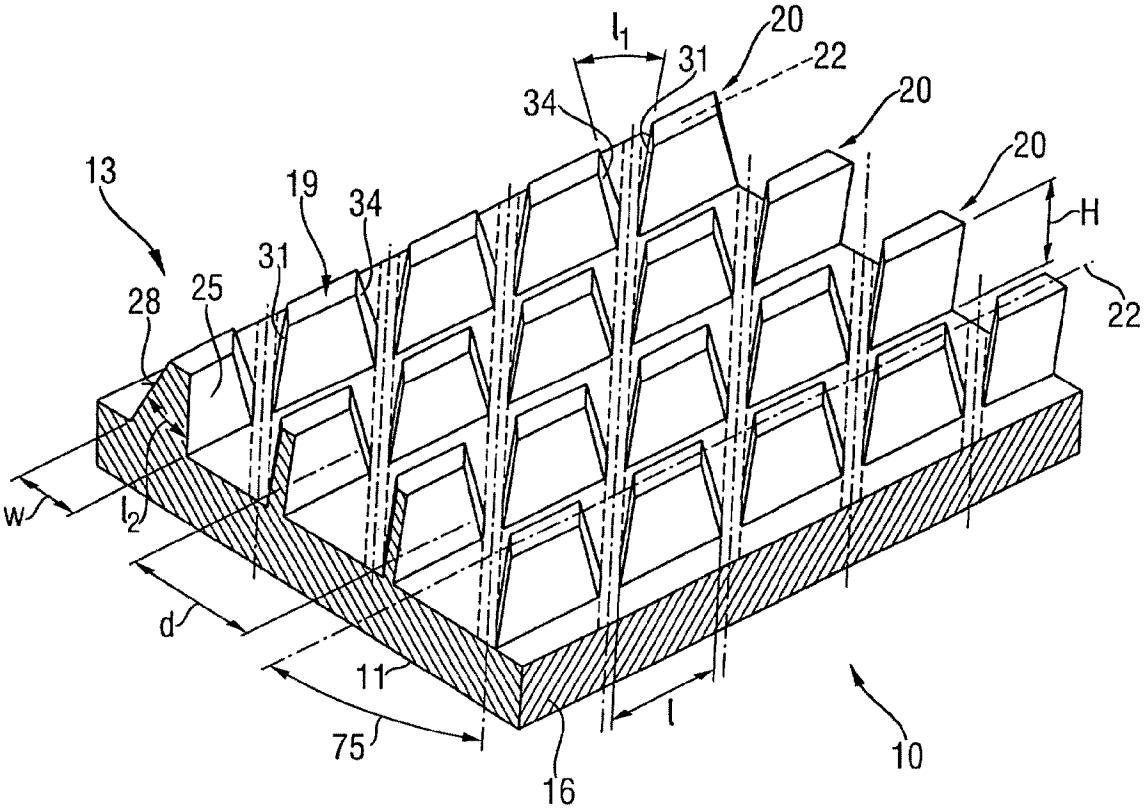
FIG. 1 is a detailed view of an individual portion of the wall of the heat exchanger.

In FIG. 1, a portion 11 of tube 10 is laid flat and shown with surface enhancement 13. Extended outward from wall 16 are a plurality of polyhedrons 19. The polyhedrons 19 are disposed in a plurality of rows 20 with each row disposed along an axis 22. The rows 20 have a helical angle 100 (FIG. 2) with respect to the longitudinal axis 50 of the tube 10, as will be described in greater detail below.

A first planar face 25 and a second planar face 28 are disposed parallel to the axis 22. A third planar face 31 and a fourth planar face 34 are disposed at an angle oblique to the axis 22. The polyhedrons 19 are disposed on the wall 16 at a distance d between center lines of the adjacent rows. Distance d can be in the range of 0.011 inches to 0.037 inches. The faces 31 and 34 form an apex angle $l_1$ that is between 5-50 degrees. The faces 31 and 34 extend downward toward the inner wall 16 of the tube 10 and may extend from twenty to one hundred percent of the height of the polyhedron 19. The length of the polyhedrons 19 is l. The length l may be from 0.005 to 0.025 inches. The third and fourth faces 31 and 34 make an angle 75 with respect to the axis 22 of the rows of polyhedrons 19. The polyhedrons have height H and have a maximum width w. The width w is in the range of 0.004 to 0.01 inches. The polyhedrons 19 have an angle $l_2$ between faces 25 and 28. Angle $l_2$ is in the range of 5 to 50 degrees. For all sizes of tubing the number of polyhedrons per 360 degree arc is determined by the pitch or d defined above. The surface enhancement 13 typically provides between 500 to 10,000 polyhedrons per square inch.

For the present invention, the ratio of polyhedron height to outside diameter is in the range of 0.005 to 0.05.

Figure 2:
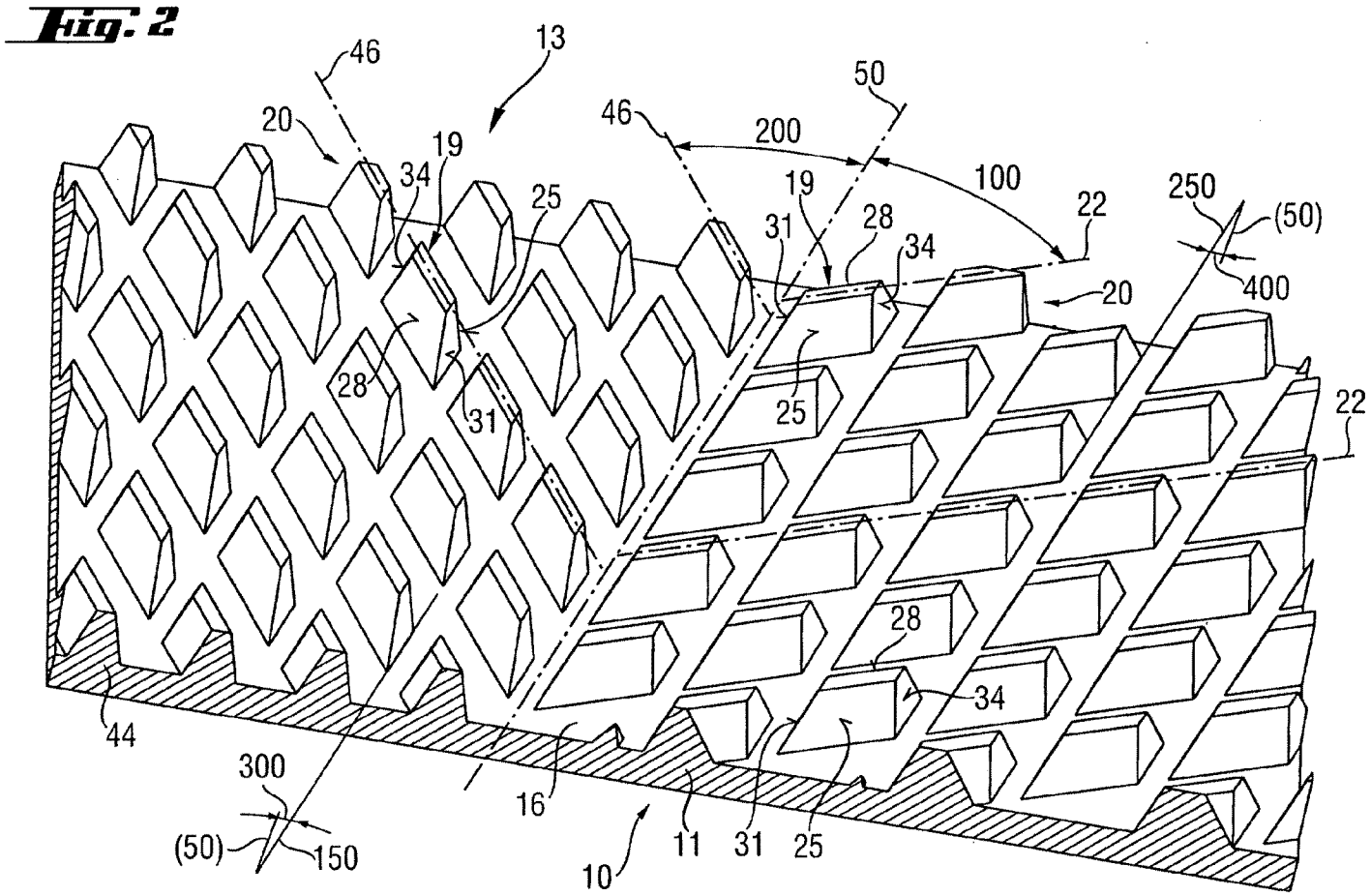
FIG. 2 is a perspective view of two adjacent portions of the wall of the heat exchanger tube of the present invention laid flat and including the individual portion shown in FIG. 1.

Turning to FIG. 2, portion 11 and an adjacent portion 44 are laid out flat and shown in one arrangement relative to the longitudinal axis 50 of the tube 10. Additional views of this portion and adjacent portion are illustrated in FIGS. 5-10. In portion 11, the axis 22 of the polyhedrons 19 is disposed at a helical angle 100 with respect to the axis 50 of tube 10.

Portion 44 is disposed adjacent to portion 11. The polyhedrons 19 are constructed in the same manner as described above. The difference between portion 11 and portion 44 is the orientation of the axis 46 of the rows of polyhedrons 19 relative to the axis 50 of tube 10. In the embodiment shown, the axis 46 is disposed at an angle 200 that is between 5 and 40 degrees and is usually disposed at an angle that is equal and opposite to angle 100. In one embodiment, the angle 200 is 15 degrees. While the adjacent portions 11 and 44 may have symmetrical helical angles 100 and 200, an asymmetrical angle is also suitable. Also, portions 11 and 44 are shown in FIG. 2 having approximately equal size. The area of portions 11 and 44 does not have to be equal. For a typical round tube there are usually four equal-sized portions.

Faces 31 and 34 of portion 11 are disposed along an axis 150 that makes an angle 300 with respect to the axis 50. Faces 31 and 34 of portion 44 are disposed along an axis 250 that makes an angle 400 with respect to the axis 50. Angles 300 and 400 are less than 10 degrees and are equal. It has been found that the angles 300 and 400 may be 0 degrees (axial). Also, the angles 300 and 400 can be 7 degrees. This arrangement reduces the pressure drop of the tube 10.

Enhancement 13 may be formed on the interior of tube wall 16 by any suitable process. In the manufacture of seam welded metal tubing using automated high-speed processes an effective method is to apply the enhancement pattern 13 by roll embossing on one surface of a metal strip before the strip is roll formed into a circular cross section and seam welded into tube 10. This may be accomplished by positioning two roll embossing stations in sequence in a production line for roll forming and seam welding metal strips into tubing. The stations would be positioned between the source of supply of unworked metal strip and the portion of the production line where the strip is roll formed into a tubular shape. Each embossing station has a pattern enhancement roller respectively and a backing roller. The backing and pattern rollers in each station are pressed together with sufficient force by suitable means (not shown), to cause the pattern surface on one of the rollers to be impressed into the surface on one side of the strip thus forming the longitudinal sides of the polyhedrons. The third and fourth faces 31 and 34 will be formed by a second roller having a series of raised projections that press into the polyhedrons 19.

If the tube is manufactured by roll embossing, roll forming, and seam welding, it is likely that there will be a region along the line of the weld in the finished tube 10 that either lacks the enhancement configuration that is present around the remainder of the tube 10 in a circumference, due to the nature of the manufacturing process, or has a different enhancement configuration. This region of different configuration will not adversely affect the thermal or fluid flow performance of the tube 10 in a significant way.

Figure 3:
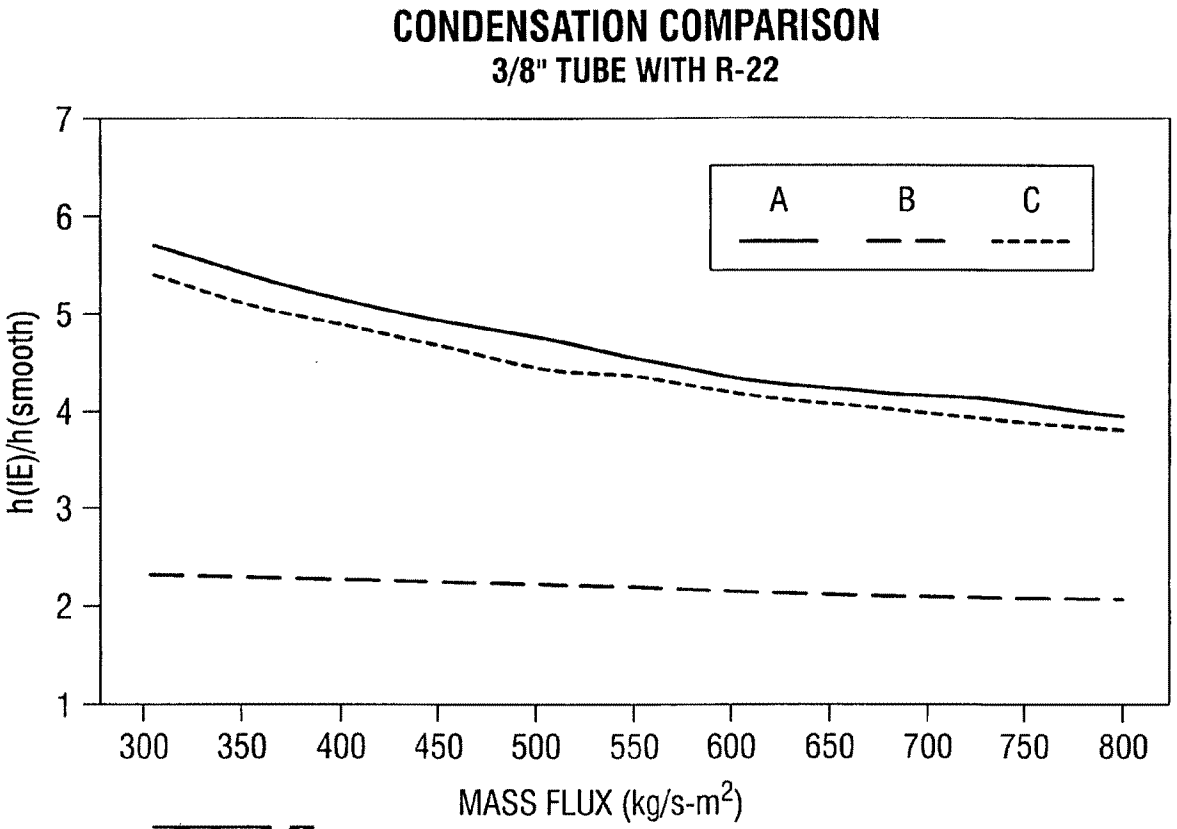
FIG. 3 is a graph showing the relative performance of the tube of the present invention compared to prior art tubes with regard to heat transfer when the tube is used in a condensing application.

Turning to FIG. 3, h represents the heat transfer coefficient, IE represents tubing with internal enhancements, and "smooth" represents plain tubing. The curves in FIG. 3 illustrate the relative condensing performances (h(IE)/h (Smooth)) of three different internally enhanced tubes compared to a tube having a smooth inner surface over a range of mass flow rate of refrigerant R-22 through the tubes. Tube A is one embodiment of the present invention. Tube B represents a prior art tube having an inner surface enhancement which is generally referred to as a cross-hatch enhancement. Tube C is another prior art tube which is generally referred to as a herringbone enhancement. The graph of FIG. 3 illustrates that condensation heat transfer performance of the present invention far exceeds the performance of the crosshatch enhancement and is slightly better than the herringbone enhancement. Accordingly, the present invention provides better performance at equal weight and equal performance at a reduced weight therefore reducing the costs to the end user.

Figure 4:
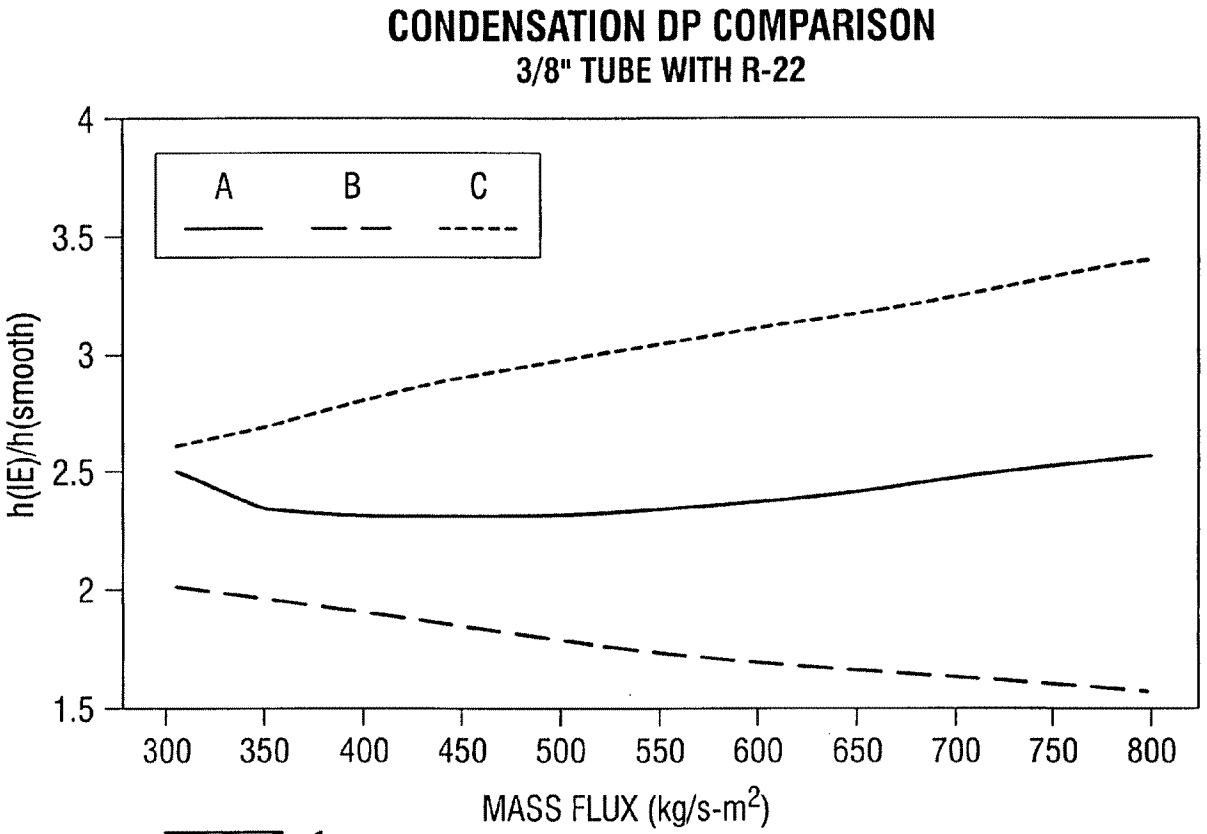
FIG. 4 is a graph showing the relative performance of the tube of the present invention compared to prior art tubes with regard to pressure drop.
Figure 5:
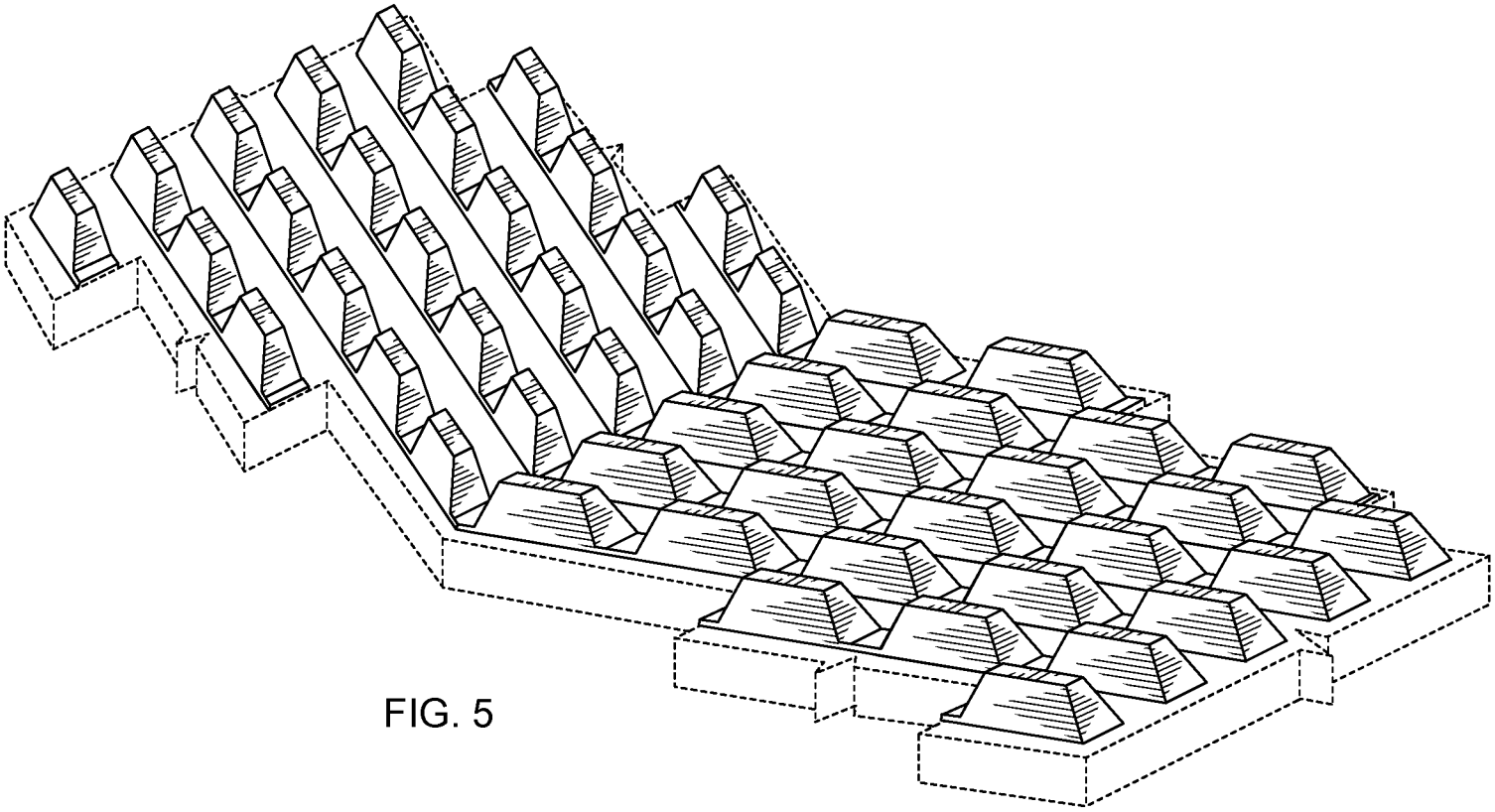
FIG. 5 is a perspective view of a portion of the wall of the heat exchanger in accordance with an embodiment of the present disclosure.
Figure 6:
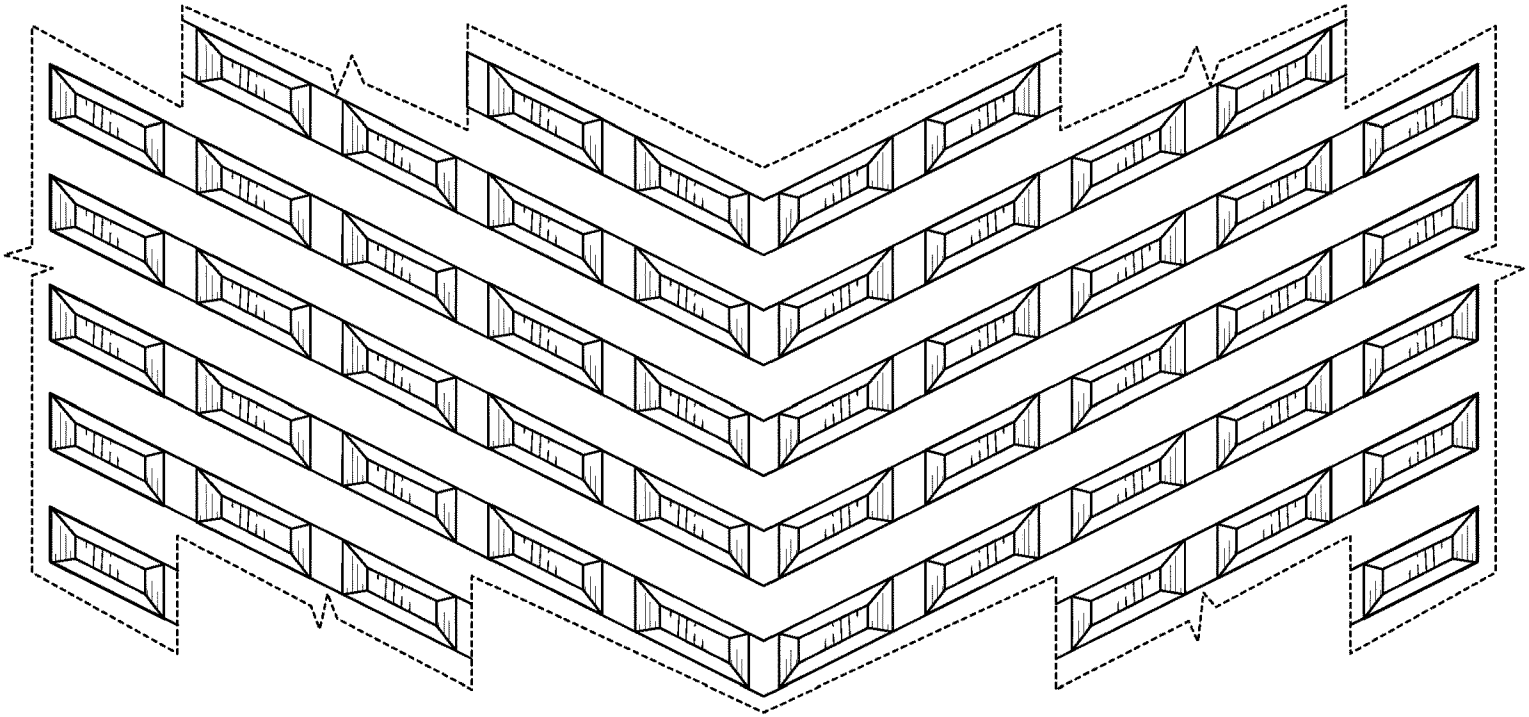
FIG. 6 is a top view of the portion of the wall of the heat exchanger in FIG. 5.
Figure 7:
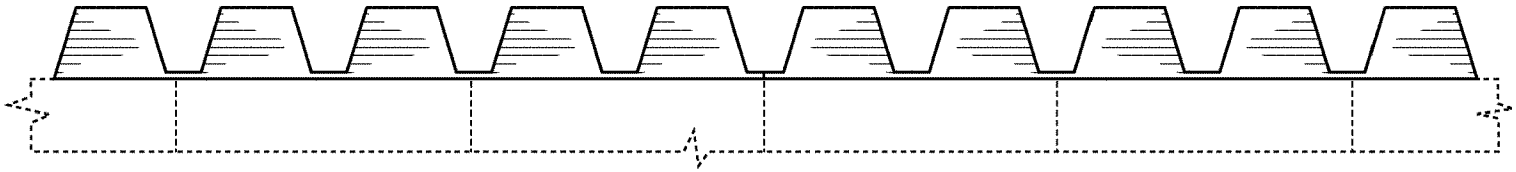
FIG. 7 is a right side view of the portion of the wall of the heat exchanger in FIG. 5.
Figure 8:
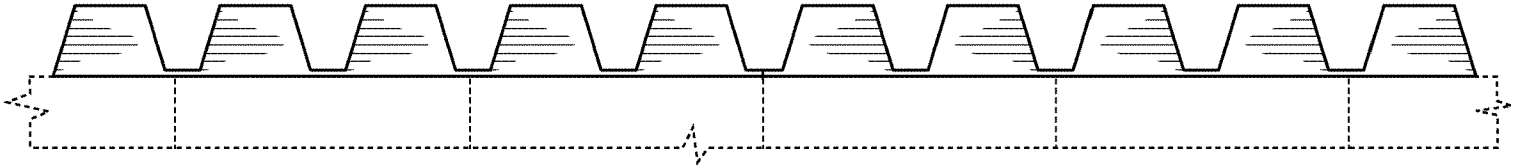
FIG. 8 is a left side view of the portion of the wall of the heat exchanger in FIG. 5.
Figure 9:
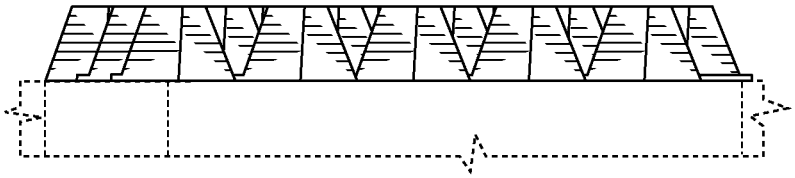
FIG. 9 is a front elevational view of the portion of the wall of the heat exchanger in FIG. 5; and, FIG. 10 is a rear elevational view of the portion of the wall of the heat exchanger in FIG. 5.
Figure 10:
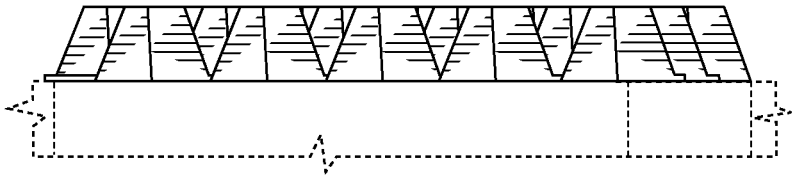

Turning to FIG. 4, the curves show the relative performance with regard to pressure drop of the above described tubes A, B, and C, over a range of mass flow rates of refrigerant R-22 through the tube. The graph of FIG. 4 indicates that condensation pressure drop of the present invention is more than 20% below the pressure drop of the herringbone enhancement, in most of the flow rate range.

The polyhedral array of the present invention creates added turbulence by directing fluid streams flowing over the surface to impact each other. If the flow is vapor-liquid two phase, it generates enough turbulence so that the vapor and liquid interfacial tear is much stronger which results in near perfect vapor-liquid mixing. The tube 10 of the present invention performs very well in condensation heat transfer, which requires strong vapor-liquid interfacial mixing.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A heat exchanger tube, comprising:

a tubular member having a longitudinal axis and having an inner surface that is divided into at least two regions along the circumferential direction;

a first plurality of polyhedrons formed on the inner surface along a first polyhedral axis, each of the first plurality of polyhedrons having four opposite sides, the first plurality of polyhedrons having first and second faces disposed parallel to the first polyhedral axis and having third and fourth faces disposed oblique to the first polyhedral axis, the first polyhedral axis disposed at a first helical angle with respect to the longitudinal axis of the tube, wherein at least two of the first plurality of polyhedrons are in a row along the first polyhedral axis, and wherein each of the first plurality of polyhedrons have a length of 0.005 to 0.025 inches and have a width of 0.004 to 0.01 inches; and, a second plurality of polyhedrons formed on the inner surface adjacent the first plurality of polyhedrons and along a second polyhedral axis, each of the second plurality of polyhedrons having four opposite sides, the second plurality of polyhedrons having first and second faces disposed parallel to the second polyhedral axis and having third and fourth faces disposed along an axis oblique to the second polyhedral axis, the second polyhedral axis disposed at a second helical angle with respect to the longitudinal axis of the tube, an orientation of the second helical angle being opposite to an orientation of the first helical angle, wherein at least two of the second plurality of polyhedrons are in a row along the second polyhedral axis, wherein each of the second plurality of polyhedrons have a length of 0.005 to 0.025 inches and have a width of 0.004 to 0.01 inches and wherein the inner surface between the first plurality of polyhedrons and the second plurality of polyhedrons has a uniform tube wall thickness.

2. The heat exchanger tube of claim 1, wherein the first helical angle is between 5 and 40 degrees.

3. The heat exchanger tube of claim 1, wherein the first helical angle is approximately 15 degrees.

4. The heat exchanger tube of claim 1, wherein the second helical angle is between 5 and 40 degrees.

5. The heat exchanger tube of claim 1, wherein the second helical angle is approximately 15 degrees.

6. The heat exchanger tube of claim 1, wherein the first and second helical angles are equal and opposite.

7. The heat exchanger tube of claim 1, wherein the first and second helical angles are asymmetrical.

8. The heat exchanger tube of claim 1, wherein an angle between the axis of the third and fourth faces and the longitudinal axis of the tube is less than 10 degrees.

9. The heat exchanger tube of claim 1, wherein an angle between the axis of the third and fourth faces and the longitudinal axis of the tube is approximately 0 degrees.

10. The heat exchanger tube of claim 1, wherein an angle between the axis of the third and fourth faces and the longitudinal axis of the tube is less than 7 degrees.

11. The heat exchanger tube of claim 1, wherein the first plurality of polyhedrons and second plurality of polyhedrons occupy regions having an approximately equal area of the inner surface of the tube.

12. The heat exchanger tube of claim 1, wherein the first plurality of polyhedrons and the second plurality of polyhedrons occupy regions having areas that are not equal.

13. The heat exchanger tube of claim 1, wherein the ratio of polyhedron height to outside diameter is approximately 0.005 to 0.05.

14. The heat exchanger tube of claim 1, wherein there are approximately 500 to 10,000 polyhedrons per square inch.

15. The heat exchanger tube of claim 1, wherein an angle between the axis of the third and fourth faces of both the first plurality of polyhedrons and the second plurality of polyhedrons and the longitudinal axis of the tube is greater than 0 degrees and less than or equal to 10 degrees.

16. A heat exchanger tube, comprising:

a tubular member having a longitudinal axis and having an inner surface that is divided into at least two regions along the circumferential direction;

a first plurality of polyhedrons formed on the inner surface along a first polyhedral axis, each of the first plurality of polyhedrons having four opposite sides, the first plurality of polyhedrons having first and second faces disposed parallel to the first polyhedral axis and having third and fourth faces disposed oblique to the first polyhedral axis, the first polyhedral axis disposed at a first helical angle with respect to the longitudinal axis of the tube, the first helical angle being between 5 and 40 degrees, an angle between an axis of the third and fourth faces of the first plurality of polyhedrons and the longitudinal axis of the tube is approximately 0 degrees, wherein at least two of the first plurality of polyhedrons are in a row along the first polyhedral axis, and wherein each of the first plurality of polyhedrons have a length of 0.005 to 0.025 inches and have a width of 0.004 to 0.01 inches; and, a second plurality of polyhedrons formed on the inner surface adjacent the first plurality of polyhedrons and along a second polyhedral axis, each of the second plurality of polyhedrons having four opposite sides, the second plurality of polyhedrons having first and second faces disposed parallel to the second polyhedral axis and having third and fourth faces disposed along an axis oblique to the second polyhedral axis, the second polyhedral axis disposed at a second helical angle with respect to the longitudinal axis of the tube, the second helical angle being 5 to 40 degrees with an orientation of the second helical angle being opposite to an orientation of the first helical angle, an angle between an axis of the third and fourth faces of the second plurality of polyhedrons and the longitudinal axis of the tube is approximately 0 degrees, wherein at least two of the second plurality of polyhedrons are in a row along the second polyhedral axis, wherein each of the second plurality of polyhedrons have a length of 0.005 to 0.025 inches and have a width of 0.004 to 0.01 inches and wherein the inner surface between the first plurality of polyhedrons and the second plurality of polyhedrons has a uniform tube wall thickness.

17. The heat exchanger tube of claim 16, wherein the first plurality of polyhedrons and second plurality of polyhedrons occupy regions having an approximately equal area of the inner surface of the tube.

18. The heat exchanger tube of claim 16, wherein the first plurality of polyhedrons and the second plurality of polyhedrons occupy regions having areas that are not equal.

19. The heat exchanger tube of claim 16, wherein the ratio of polyhedron height to outside diameter is approximately 0.005 to 0.05.

20. The heat exchanger tube of claim 16, wherein there are approximately 500 to 10,000 polyhedrons per square inch.

* * * * *